US006631862B2

(12) United States Patent
Schilling et al.

(10) Patent No.: US 6,631,862 B2
(45) Date of Patent: Oct. 14, 2003

(54) APPARATUS FOR BEATING STALK-, STEMS-AND/OR SHEET-TYPE REGENERATIVE RAW MATERIALS

(75) Inventors: Ehrhard E. Schilling, Cologne (DE); Dagmar Gaese, Rösrath-Forsbach (DE); Josef Rickert, Rösrath (DE)

(73) Assignee: Raiffeisen-Waren-Zentrale Rhein-Main eG (DE)

( * ) Notice: Subject to any disclaimer, the term of this patent is extended or adjusted under 35 U.S.C. 154(b) by 40 days.

(21) Appl. No.: 09/941,113

(22) Filed: Aug. 28, 2001

(65) Prior Publication Data

US 2002/0030131 A1 Mar. 14, 2002

(30) Foreign Application Priority Data

Aug. 28, 2000 (DE) ..... 100 42 195

(51) Int. Cl.[7] ..... B02C 18/16
(52) U.S. Cl. ..... 241/74; 241/242
(58) Field of Search ..... 241/74, 199.12, 241/242, 243, 261.1, 260, 261, 286, 257.1, 259.1, 46.017, 46.06

(56) References Cited

U.S. PATENT DOCUMENTS 2,886,254 A * 5/1959 Rohlinger et al. ..... 241/74
4,663,030 A * 5/1987 Chupka et al. ..... 209/306
5,395,059 A * 3/1995 Satake et al. ..... 241/74
5,752,664 A * 5/1998 Satake et al. ..... 241/74

FOREIGN PATENT DOCUMENTS

DE 437 931 C 11/1926
DE 856 553 3/1953

* cited by examiner

*Primary Examiner*—Mark Rosenbaum
(74) *Attorney, Agent, or Firm*—R W Becker & Associates; R W Becker

(57) ABSTRACT

An apparatus for disintegrating or beating stalk-, stem- and/or sheet-type regenerative raw material that includes a stator and a rotor is provided. The stator is configured as a sieve drum on whose inner wall radially inwardly-directed, teeth-like projections are provided as disintegration tools. The rotor has a rotor hub and a plurality of radially outwardly-directed arms mounted on the rotor hub, a plurality of axially-directed support bars mounted to the ends of the arms, and a plurality of radially outwardly-directed disintegration tools mounted on the support bars.

13 Claims, 2 Drawing Sheets

APPARATUS FOR BEATING STALK-, STEMS-AND/OR SHEET-TYPE REGENERATIVE RAW MATERIALS

BACKGROUND OF THE INVENTION

When referring to the term "beating" or "disintegrating", one is commonly understood to be referring to the loosening of a substance having a fibrous structure into fiber bundles or individual fibers. Such beating or disintegration has heretofore figured most significantly in the paper and pulp industry. The conventionally-deployed mechanical beating or disintegrating process exploits the fact that the connections between the fibers are weaker than the connections within the fibers. The beating demand should, to the greatest extent possible, result in shear stress or strain in the direction of the fibers, supported by the tensile stress or strain perpendicular thereto, while the tensile strain or stress in the fiber direction leads to disintegration or separation of the fibrous structure into individual fibers.

Machines for beating or disintegrating in use in the paper and pulp industry are, for example, the beater and the disk crusher, especially the disk crusher having toothed disk mill with two teeth plates of which one plate rotates and the other plate stands still.

The disk mill deployed for wet beating is comprised of two flat disks or hollow cones which are arranged on a shaft horizontally or vertically. One of the disks (the rotor) rotates and the other disk (the stator) stands still. The grinding phase of the disks are either serrated or, in the case of toothed disk mills, the disks possess, instead of serrations, concentric teeth rings which engage one another and have sharp edges.

It is further conventionally known to deploy conical material mills having a fixed housing provided with knives, the housing having a conical shape and having therein a conical stump of a predetermined size which rotates.

In the above-noted beating situations, the descriptions have related to machines for wet beating.

DE 437 931 C discloses an apparatus for separating the fibers of plant stacks and for follow up cleaning of the thus yielded, spinnable fibers. In this apparatus, a drill drum having a plurality of drill tools mounted on its outer periphery and a removal shaft having fibrous material removal workpieces mounted to the outer periphery thereof are operated cooperatively with one another such that the removal shaft initially removes the fibrous material from the drill drum and thereafter the entirety of the fibers are fed back to the drill drum for a cleaning operation, whereby the drill drum and the removal shaft are wrapped with grates at certain peripheral regions.

DE 845 553 discloses an apparatus for yielding spinnable fibers from fiber containing sheets and similar plant materials, the apparatus including a nail drum having nails mounted on its outer periphery and rotating within a full walled housing which has an opening for a pair of fiber material removal shafts. A shaft extends through the housing wall between the fiber material loading location and the fiber material removal opening and rotates oppositely to the nail drum, the shaft having tools thereon which exert a scraping application on the fiber material.

SUMMARY OF THE INVENTION

The present invention offers a solution to the challenge of providing an apparatus for dry beating of stalk-, stem-and/or sheet-type raw materials in order to create disintegrated material which comprises only a very small dust or debris portion and which can ultimately be pressed into pellets destined for dispersal as disbursal material for animals without the need for limiting the use of the disintegrated goods to this application alone. In this connection, it is ensured that, especially in connection with a predetermined use of the disintegrated goods for the production of disbursal materials, the dust or, respectively, the powder component thereof, is reduced to the greatest possible extent, as an increased dust portion in pellets to be used as animal disbursal material can lead to detrimental health consequences for the animals.

In connection with the present invention, the dry raw material is led to the sieve drum whereat it is accelerated radially outwardly by a rotating rotor and is beaten or disintegrated between size reducing tools which pass nearby in the circumferential direction, whereby it can be presumed that the stalk-or stem-type raw material is subjected to shear stress or strain in the direction of the fibers, supported or reinforced by the tensile stress or strain perpendicular thereto as well as by the tensile stress or strain in the fiber direction. The outletting or discharge of the disintegrated material is effected through the sleeve surface of the stator embodied as a sieve drum, whereby, in dependence upon the particle size, the disintegrated goods pass through the selected sieve holes having a predetermined size which is chosen in order to correspondingly increase or decrease the residence time of the goods in the drum.

A sieve hole size in the region of approximately 5×5 mm has been shown to be particularly favorable for a right-angled hole or as a corresponding opening cross-sectional size in connection with round holes.

The friction-producing tools on the inner wall of the sieve drum are preferably configured as friction-producing tools in the manner of a grating device for cooking having sharpened apexes and/or sharp-edged projections. The friction-producing tools are preferably axially oriented, and preferably exchangeable, friction bars or strips.

In an advantageous modification of the embodiment of the apparatus of the present invention, two disintegration steps are provided—namely, a gross or large-scale disintegration effected between the disintegration tools of the stator extending inwardly and the disintegration tools of the rotor extending radially outwardly, and a fine or small particle reduction effected between the disintegration tools disposed on the inner wall of the stator and the disintegration tools on the rotor extending outwardly therefrom.

BRIEF DESCRIPTION OF THE DRAWINGS

The object and advantages of the present invention will appear more clearly from the following specification in conjunction with the accompanying schematic drawings, in which.

DETAILED DESCRIPTION OF THE PREFERRED EMBODIMENT

Figure 1:
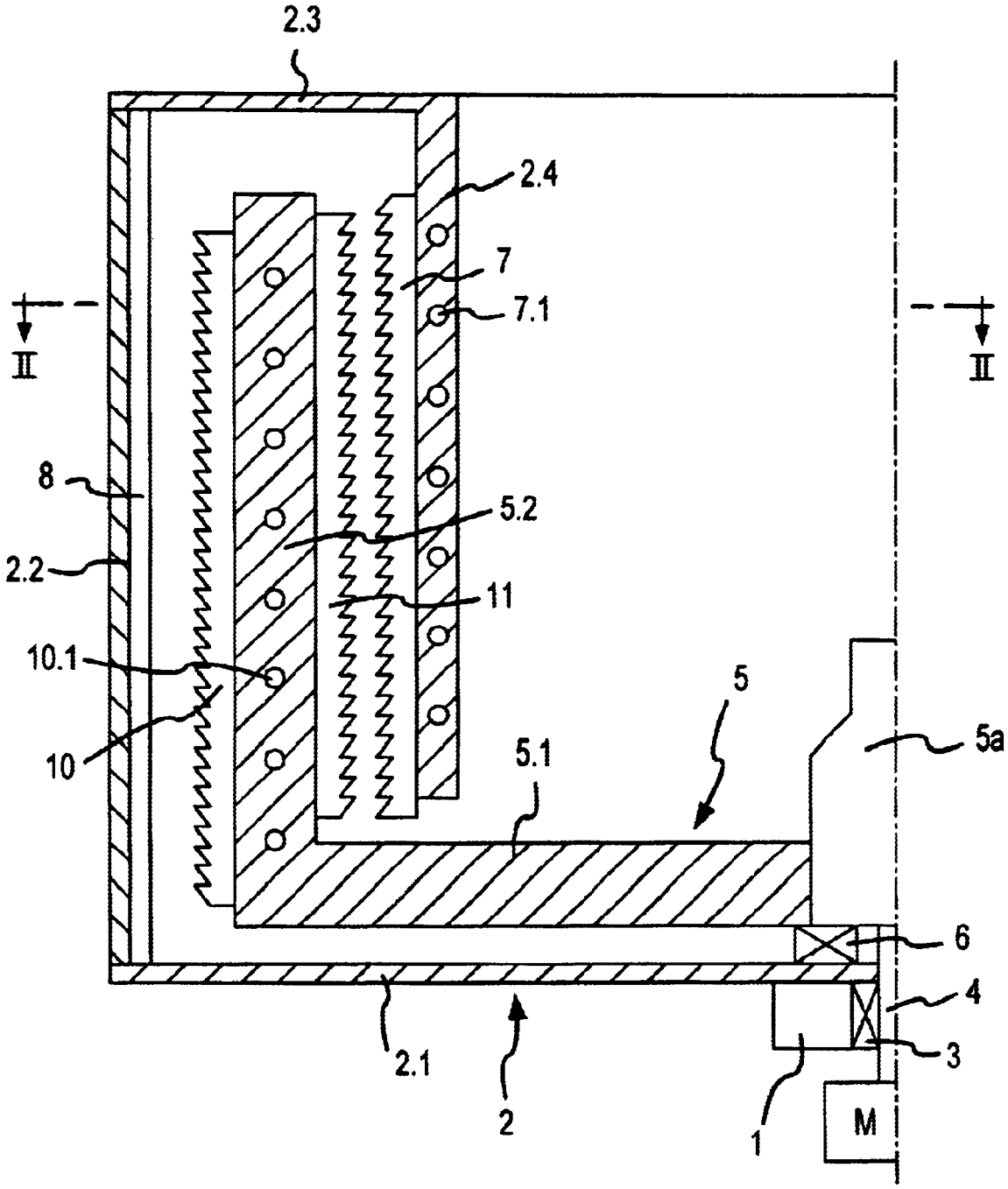
FIG. 1 is a sectional axial view of the apparatus of the present invention.
Figure 3:
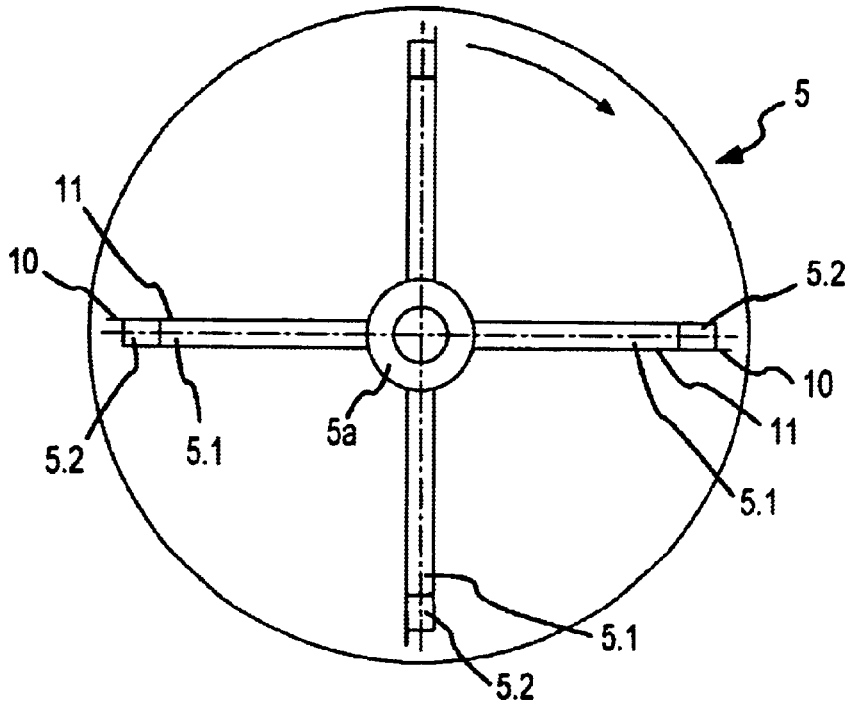
FIG. 3 is a schematic view of the rotor alone of the inventive apparatus taken along line II—II in FIG. 1.

As seen in FIG. 1, in which a schematically-illustrated machine frame 1 is shown, the stator 2 of the inventive apparatus is mounted on the machine frame. The shaft 4 of the rotor 5 is rotatably mounted on the machine frame 1 via a bearing 3 and the rotor 5 is rotatably mounted, via a bearing 6, to the bottom 2.1 of the stator 2. The driving rotation of the rotor 5 is effected by means of the motor M.

Figure 2:
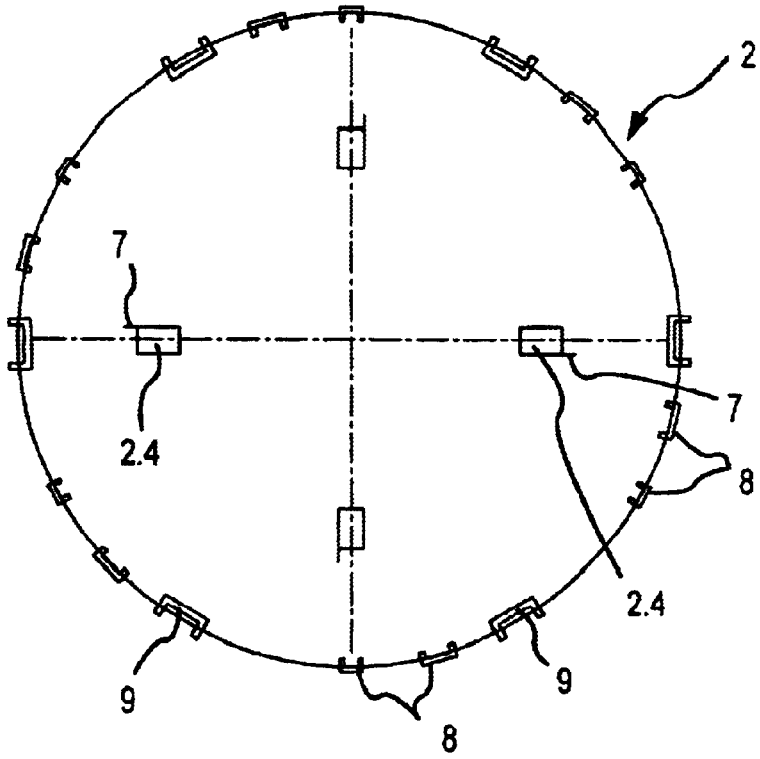
FIG. 2 is a schematic illustration of the stator of the inventive apparatus alone taken along line II—II in FIG. 1.

The stator 2 comprises a sieve drum 2.2 whose sieve openings have, for example, a cross-section of 5×5 mm or a corresponding cross-sectional surface in connection with round sieve openings. A plurality of, for example four, radially inwardly-directed arms 2.3 are fixed to the upper edge of the sieve drum 2.2, the length of each arm being smaller than one half of the radius of the sieve drum 2.2. Axially-directed carry bars 2.4 are fixedly-connected to the inner sides of the arms 2.3 and extend axially into the sieve drum 2.2, the support bars 2.4 supporting thereon radially outwardly-directed disintegration tools which are preferably in the form of teeth sheets or blades 7. Radially inwardly-directed disintegration tools 8 and 9 are disposed on the inner wall of the sieve drum 2.2—see as well FIG. 2—and these friction-producing tools are configured in the form of a grater for cooking having sharpened apexes and/or sharp-edged projections or, respectively, teeth, whereby the tool 9 has a friction and disintegration function as well as a hold-back function. The sharpened apexes and/or sharp-edged teeth, which are configured in the manner of those of a grater for cooking, are preferably comprised as portions of an axially extending and exchangeable friction bar or strip.

The rotor 5 comprises a plurality—preferably four—rotor arms 5.1 fixed to the rotor hub 5*a* and extending radially inwardly, the ends of the rotor arms 5.1 having axially extending support bars 5.2 secured thereto, which include radially inwardly-directed as well as radially outwardly-directed disintegration tools preferably in the form of saw-tooth sheets or templates 10 or, respectively, 11. The teeth plate 7 of the stator 2 as well as the sawtooth sheets 10 and 11 of the rotor 5 are secured by means of screws or bolts 7.1 or 10.1, respectively, on the support bars 2.4 or, respectively, 5.2 in a manner such that they can be adjusted to effect variation of the width of the gap between the cooperating disintegration tools in the radial direction.

The sieve drum can, as illustrated, be configured as a cylinder drum; it can also, however, be configured as a conical drum with a cross-section which expands in the direction of the drum bottom or which has a tapering cross-section.

The component height and the diameter of the sieve drum is selected in correspondence with the material to be beaten or disintegrated in order to achieve the desired throughput and the desired grade of beating or disintegration.

The drum axle can include an angle to the vertical between 0° and 90°.

The peripheral speed of the rotor 5 in the region of the support bars 5.2 can lie between 5 meters per second and 25 meters per second, and, indeed, can be, as a function of the material to be beaten or disintegrated, selected to achieve the desired throughput and the desired grade of disintegration. The peripheral speed should, however, be chosen in dependence of the raw material to be disintegrated to have a value such that only a relatively small dust or debris component occurs.

The rotor 2 is preferably provided with a housing, not illustrated, which includes a disintegrated material discharge opening which is, preferably, communicated with a cleanout arrangement preferably in the form of a centrifugal force ejector.

In connection with the inventive apparatus, substantially large amounts of stalk-, stem-and/or sheet-type plants, such as grains, rapeseed, and corn straw as well as alfalfa, hay and so forth can be processed.

The specification incorporates by reference the disclosure of German priority document 100 42 195.4 of Aug. 28, 2000.

The present invention is, of course, in no way restricted to the specific disclosure of the specification and drawings, but also encompasses any modifications within the scope of the appended claims.

What we claim is:

1. An apparatus for disintegrating or beating stalk-, stem-and/or sheet-type regenerative raw material, comprising:

a stator configured as a sieve drum on whose inner wall radially inwardly-directed, teeth-like projections are provided as disintegration tools; and a rotor having a rotor hub and a plurality of radially outwardly-directed arms mounted on the rotor hub, a plurality of axially-directed support bars mounted to the ends of the arms, and a plurality of radially outwardly-directed disintegration work pieces mounted on the support bars.

2. An apparatus according to claim 1, wherein the sieve drum has a free edge and the stator further comprises a plurality of arms fixed to the free-edge of the sieve drum and oriented radially inwardly, the length of the arms being smaller than one-half of the drum radius, and a plurality of support bars extending axially in the sieve drum fixed to the ends of the arms, the support bars having radially outwardly-oriented disintegration tools mounted thereon and the support bars of the rotor having radially inwardly-oriented disintegration tools mounted thereto.

3. An apparatus according to claim 2, wherein the tools secured to the support bars of the stator and the rotor are radially adjustable.

4. An apparatus according to claim 1, wherein on the support bars of the stator and the rotor, the tools secured thereto have the form of saw sheets.

5. An apparatus according to claim 1, wherein the disintegration tools on the inner wall of the sieve drum are configured in the manner of those of a grater for cooking, having sharp apexes and/or sharp-edged projections.

6. An apparatus according to claim 5, wherein on the disintegration tools disposed on the inner wall of the sieve drum, friction-producing frames or bars are configured which are axially extending and are a selected one of exchangeable frames or bars or non-exchangeable frames or bars.

7. An apparatus according to claim 1, wherein the disintegration tools on the inner wall of the sieve drum are configured as sharp-apexed and/or sharp-edged teeth.

8. An apparatus according to claim 1, wherein the disintegration tools on the inner wall of the sieve drum are configured as axially extending hold-back bars.

9. An apparatus according to claim 1, wherein the sieve drum is a cylinder drum.

10. An apparatus according to claim 1, wherein the sieve drum is a conical drum and the support bars of the stator and the rotor follow the inclination of the conical drum sleeve.

11. An apparatus according to claim 1, wherein the sieve drum axis is oriented relative to the vertical at an angle between 0° to 90°.

12. An apparatus according to claim 1, wherein the sieve drum is disposed within a housing which comprises a disintegrated material discharge opening.

13. An apparatus according to claim 12, wherein a cleaning out structure is communicated with the fibrous material discharge opening and is in the form of a centrifugal force discharge structure.

* * * * *